United States Patent [19]

Itani et al.

[11] 4,051,796

[45] Oct. 4, 1977

[54] METHOD OF BREAKING UP SHIP HULL

[75] Inventors: Mituo Itani, Chiba; Hiroyuki Kawashima, Yokohama; Takasuke Inoue, Kunitachi; Mikio Maruyama, both of Tokyo, all of Japan

[73] Assignee: Mitsui Engineering & Shipbuilding Co., Ltd., Tokyo, Japan

[21] Appl. No.: 766,020

[22] Filed: Feb. 7, 1977

[30] Foreign Application Priority Data

| | | |
|---|---|---|
| Mar. 18, 1976 | Japan | 51-29615 |
| Mar. 18, 1976 | Japan | 51-29616 |
| Mar. 18, 1976 | Japan | 51-29617 |

[51] Int. Cl.[2] ..... B63B 35/44; B63C 7/00

[52] U.S. Cl. ..... 114/44; 83/925 R; 114/77 R; 114/79 R; 114/268; 114/270; 212/3 R; 214/13

[58] Field of Search ..... 114/45, 46, 44, 77 R, 114/79 R, 270, 264, 268, 65 R, 26, 25, 230; 29/403, 426

[56] References Cited

U.S. PATENT DOCUMENTS

| | | | |
|---|---|---|---|
| 3,300,187 | 1/1967 | Saxe et al. | 114/230 |
| 3,326,162 | 6/1967 | King | 114/45 |
| 3,680,512 | 8/1972 | Yamura | 114/77 R |
| 3,765,359 | 10/1973 | Takezawa | 114/65 R |
| 3,811,583 | 5/1974 | Weeks | 114/45 X |
| 3,820,258 | 6/1974 | Fahrner | 114/26 |
| 3,962,981 | 6/1976 | O'Kon et al. | 114/264 |

*Primary Examiner*—Trygve M. Blix
*Assistant Examiner*—Gregory W. O'Connor
*Attorney, Agent, or Firm*—Armstrong, Nikaido & Marmelstein

[57] ABSTRACT

The present invention is characterized by cutting and breaking up a hull of large ship in the floating situation on the sea so as to shorten the length of the hull, transporting the broken up objects to a product making workshop, and subdividing said objects further thereby breaking up into products. Said product making workshop is constructed so as to supply power etc. required for the breaking up process.

A breaking up method according to the present invention does not require harbor facilities such as crane etc. so that it does not have any limitation with respect to the breaking up place and since it allows the product making operation from the broken up objects to be performed on the sea, the breaking-up process can be simplified.

4 Claims, 5 Drawing Figures

METHOD OF BREAKING UP SHIP HULL

BACKGROUND OF THE INVENTION

The present invention relates to a method of breaking up a ship hull, particularly a large ship hull.

In ships, there are generally used a large amount of metal materials of high quality, and when a ship becomes a scrapped vessel, this is broken up into small pieces of metal materials (bar materials, plate materials, shape steels) thereby producing articles of commerce or selling them as scrapped materials.

In the prior art working method of breaking up a ship hull, the portion of hull floating above the sea is cut off into large masses (in general, this is referred to as large separation), these masses are hung up by means of a marine crane or a land overhang crane and disposed on the land and then cut into small pieces (in general, this is referred to as small separation). Next, after the end of the breaking-up of the portion existing above the water surface, the submerged portion existing under the water surface is towed onto a shallow, and waiting the ebb-tide, the hull portion appearing above the water surface thereby is then subjected to said large separation and subsequently to the small separation in the same manner as described above.

In the case of said prior art hull breaking-up method, there are required a place where the hull is moored, a shallow, a quay wall where the broken-up objects are landed, a broad place where the broken-up objects are subjected to the small separation and auxiliary facilities, and it is not always possible to perform the breaking-up operation at any place. As another problem, the two steps of the breaking-up operations, namely the large and small separations are parformed at separate places, so that the transportation by crane is required, and the working number required for said transportation amounts to as much as 30% of the whole working number of breaking-up operation, and also there is a further problem that many workmen are required because the breaking-up working locations are distributed at a plurality of points.

Under such circumstances, the prior art working method has a severe limitation to the breaking-up place and requires many workmen, so that it is inevitable for the scraps or metal materials usable immediately to become high in value.

DETAILED EXPLANATION OF INVENTION

The present invention has been obtained to solve said drawbacks of the prior art breaking-up method, and provides a method of breaking up a hull floating on the sea into scraps or articles of commerce such as plate materials or bar materials at its location. In other words, the present invention provides a method of breaking up a hull, without any limitation in place such as necessity of using of harbor facilities as is in the prior art breaking-up method, and with high efficiency.

To attain said object, the present invention lies in a ship hull breaking-up method characterized in that there are provided a cutting workshop movable forth and back with respect to a hull, and a product making workshop which is connected to the hull and has a function to further cut the materials cut off in said cutting workshop and press them as required to make products and has another function to supply power to said cutting workshop, and by utilizing said workshops the hull is subdivided in the cutting workshop and the subdivided objects are fed to the product making workshop to make them products.

In addition, in the present invention, the following inventions are applied at the step previous to the breaking-up of the hull into desired products.

Namely, the basic invention for carrying out the present invention is a working method of breaking up a hull characterized by floating up the stem portion or the stern portion of a hull above the water surface and locating a cutting workshop (marine workshop) at said floated portion, thereby breaking up the hull so as to shorten the length thereof gradually.

According to this invention, harbor facilities such as crane and other means are not required as is in the prior art breaking-up method, and it is possible to break up the hull of a large ship under the lee of an island or at other suitable location on the sea, and in this respect this invention is superior.

It is important to adjust the relative position between the marine workshop for breaking up the hull and this hull, and the present invention adopts the following method therefor, namely a method of breaking up a hull characterized by floating up a portion of the hull by causing the hull to be inclined by attaching a buoyancy body under the stem or the stern of the hull, locating a cutting workshop (marine workshop) at said floated portion, connecting between the hull and the marine workshop by means of a wire, thereby giving a relative movement between the hull and the marine workshop and at the same time breaking up the hull so as to shorten the length of the hull gradually.

Hereinafter, the invention will be explained with reference to the drawings.

Figure 1:
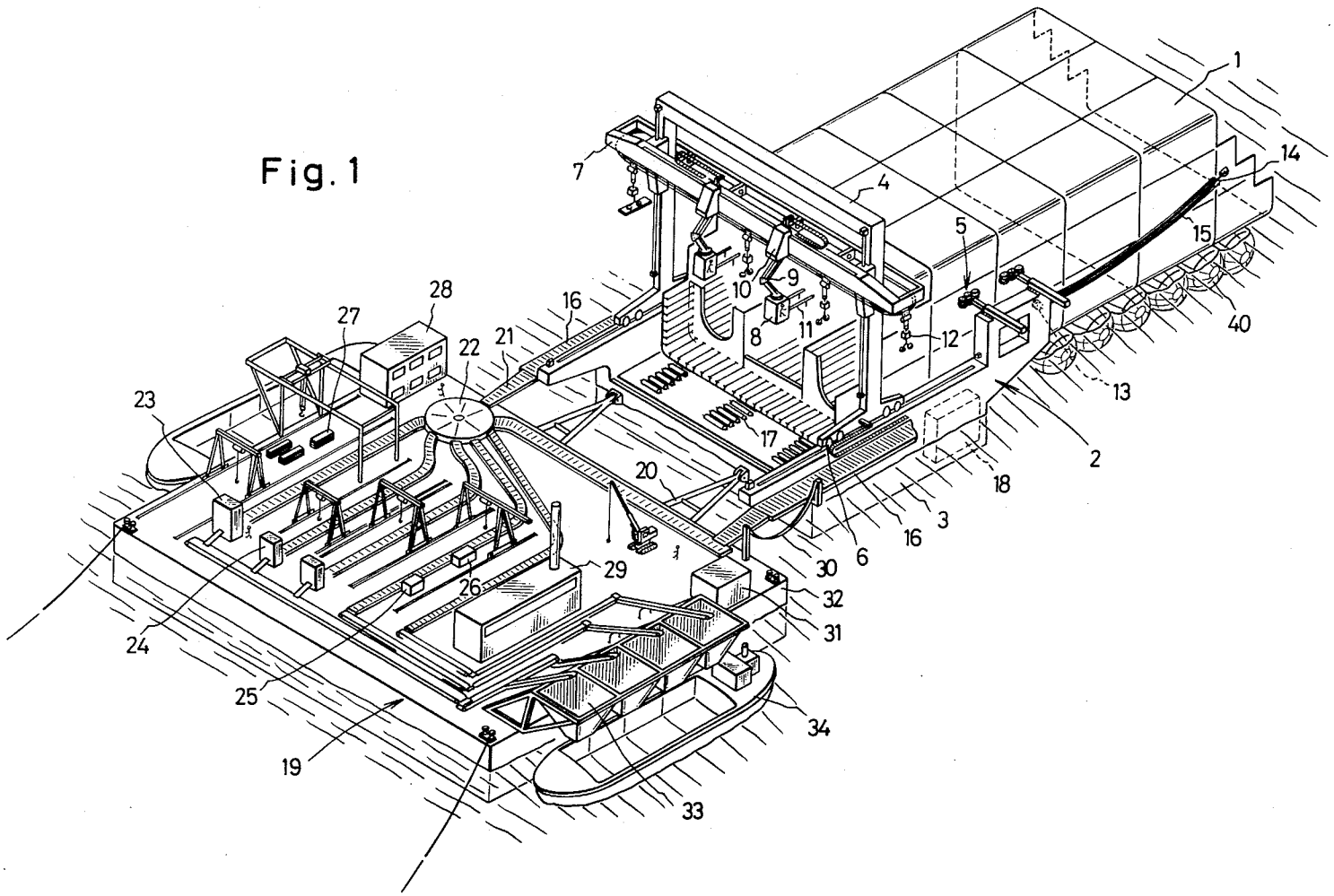
FIG. 1 is a view showing an embodiment of the present invention, wherein a portion of a large hull is laid on a cutting workshop, where rough cutting operation is performed, and thereafter the roughly cut object is subdivided into required materials in a product making workshop located alongside said cutting workshop.

FIG. 1 is a perspective view showing a situation of breaking-up of the hull of a large ship.

1 is a hull under the breaking-up operation, and in this figure the stem portion and the stern portion have been already broken up and only the remaining intermediate portion is shown. 2 is a cutting workshop, the main part of which is composed of a barge 3 in which the portion located adjacent to the ship bottom and the portions located adjacent to the both broadsides form U-shape in section, a cutting and transporting machine 4 and a broadside supporting device 5.

The cutting and transporting machine 4 has a kind of portal crane which moves longitudinally of the hull by means of a moving device 6 and causes a frame to move up and down. On the frame 7, a gondola 8 is mounted for moving up and down through an arm 9 and a travelling device 10 is mounted for moving laterally. 11 is a cutting machine which is operated by a workman on the gondola 8, and cut off metal materials etc. are transferred by means of a hoist having a magnet. The cutting machine 11 supports a cutting nozzle movably on a rail which is mounted thereon for rotation and for rocking movement up and down, so that the cutting nozzle can be directed in any direction and moved three-dimensionally. Also, due to the up and down movement of the arm 9 and a rotary plate mounted between said arm 9 and gondola 8, the direction and position of the gondola 8 with respect to the hull can be changed in various ways through the arm 9.

In the vertical portion of the barge 3 there are provided a broadside supporting device 5 and an endless winch 13, said broadside supporting device 5 is adapted to hold the hull 1 and guide it when it is moved. The endless winch 13 is adapted to move the relative position between the hull 1 and the barge 3, and this is performed by pulling a wire 15 stretched between a pulley 14 and the endless winch 13.

On both sides of the barge 3 there are provided roller conveyors 16, and at the center portion carrier conveyors 17 are provided. 18 is an oil-water separating device and an oil tank, which is adapted to separate oil part leaked out from the hull 1 and collect it. 19 is a product making workshop which is connected with the end portion of said cutting workshop 2 through a connecting rod 20 so as to permit rocking motion thereof. This product making workshop 19 receives cut objects fed via the conveyors 16 onto another conveyor 21 and these cut objects are supplied to a rotary classifying machine 22 and classified thereby and then supplied to a large shear 23, a small shear 24, a breaker 25 and a cutting machine 26. 27 is a product yard, 28 is a control room and office, and 29 is a power room, the electric power and compressed air etc. obtained in said power room are supplied to the cutting workshop 2 through cab tires and hoses 30. 31 is a gas bombe chamber, 32 is a barge composing the main body of the product making workshop, 33 is a product hopper, and 34 is a transporting ship.

Next, the method of breaking up a hull of a large ship into large masses will be explained.

FIGS. 2 through 5 show this breaking-up method, and at first a hull 1 to be broken up is moored on an appropriate place on the sea, and before starting of the breaking-up, a bouyancy body 40 is inserted, for example, under the stem 1*a* to float up the stem 1*a*. Thereafter the cutting workshop 2 is located under the stem 1*a* and then the breaking-up working is progressed by using this marine workshop 2. In this working the conventional melt cutting press is mainly used.

Figure 2:
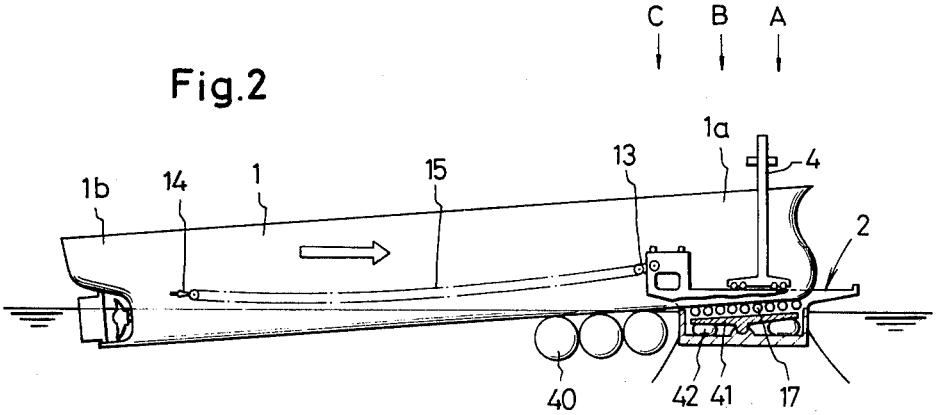
FIGS. 2 through 5 are views respectively showing situations where a hull is broken up so as to shorten the length of the hull by using the cutting workshop.

The breaking-up operation is performed, for example, in the order of the arrows A→B→C (FIG. 2). Namely, different from said exemplified lateral breaking-up manner wherein the breaking-up is progressed from the floating portion to the submerged portion in the lateral direction, the present breaking-up is performed in the longitudinal direction (or in the direction to shorten the length of the hull).

Figure 3:
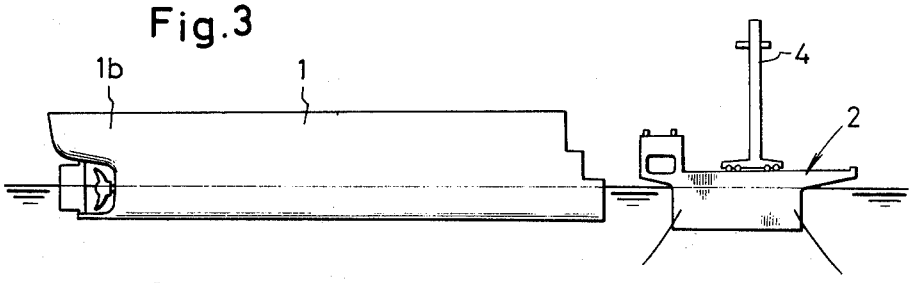

FIG. 3 shows a situation where the first stage of the breaking-up has completed, wherein the cutting workshop 1 has been disengaged from the hull 1 and the buoyancy body 40 located under the ship bottom has been also disengaged.

Figure 4:
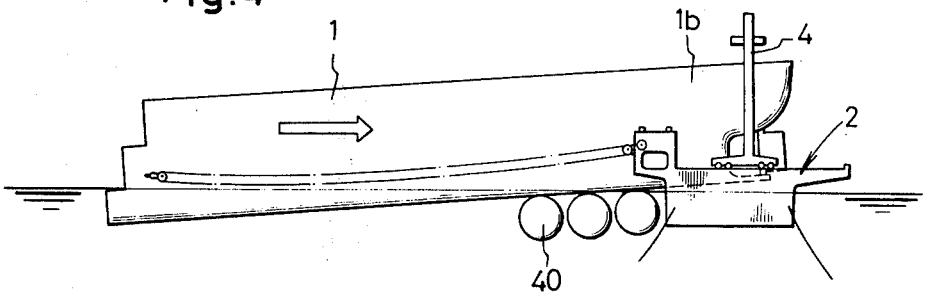

Next, as shown in FIG. 4, the hull 1 is reversed in its forth and back positions, and this time the buoyancy body 40 is inserted on the side of the stern 1*b* to floating up the stern 1*b* and the cutting workshop 2 is inserted thereunder and thus the breaking-up operation is progressed. As the breaking-up operation proceeds, the cutting workshop 2 is required to displace, and as a method to perform this displacement, for example as shown in FIGS. 1 and 2, a pulley 14 is provided on each side of the hull 1, and a wire 15 is stretched between the pulley 14 and the winch 13 and thereby a relative movement between the hull 1 and the cutting workshop 2 is caused.

41 is a support plate, and an air cushion 42 is provided under said support plate 41, and carrier conveyors 17 are provided on said plate 41, so that the load of the hull 1 is supported in distributed manner and also the cutting workshop 2 is made easy to move relative to the hull 1. The cutting workshop forms a kind of barge (buoyancy body), and when viewing from the front, it has U-shape in section, and on both sides a crane, cutting and transporting machine 4 is provided, and also the power means and other means necessary for the working are mounted thereon as a unit.

Figure 5:
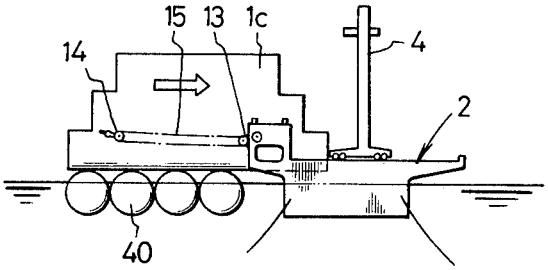

FIG. 5 shows a situation wherein the breaking-up operation has further proceeded, wherein the hull 1*c* is broken up in the longitudinal direction and then drawn in toward the cutting workshop 2 by means of the winch 13 as shown by the arrow thereby gradually progressing the breaking-up working.

According to the breaking-up method of a hull shown in FIGS. 2 through 5, a hull is floated on the sea and in the cutting workshop a rough breaking-up operation is performed, and then the roughly cut off objects are subdivided into desired products, so that it is advantageous in viewpoint of place and particularly it is possible to proceed the breaking-up operation in a place having no harbor. Also, the prior art working method has required many operations because largely separated masses are transferred by means of cranes, but according to the present invention, such operations can be quite omitted, and the working from the large separation to the small separation can be carried out continuously on the sea.

Also, since the hull is cut in the longitudinal direction so as to gradually shorten its length, the relative movement of the marine workshop to the hull ends at a time, so that from this meaning, the operation time can be shorten.

Again, explaining the present invention with reference to FIG. 1, in the cutting working at the cutting workshop 2, the workman on the gondola 8 adjusts the height and direction of this gondola 8 thereby adjusting the direction and position of the cutting machine 11 and cuts the hull 1 into small pieces and places them on the roller conveyor 16 by means of a hoist 12 having magnet, and then these pieces are transferred onto the conveyor 21 and into the rotary classifying machine 22 and classified therein and then transferred to the places of various devices where they are subject to various treatments.

Products or scraps obtained by the treatments described above are loaded on a transporting ship 34 via a product hopper 33 and landed. Also, power, gas compressed air and electric power necessary for the cutting workshop are supplied from the product making workshop.

According to the present invention, the cutting workshop and the product making workshop are connected organically, and as the hull is drawn into the cutting workshop the breaking-up working is progressed and the broken-up objects thus obtained are fed to the product making workshop, where they are made into products or scrapped materials, so that all the breaking-up operations can be carried out on the sea.

Possibility of carrying out the breaking-up on the sea almost removes limitations to place and facilities which were attendant in the prior art breaking-up method. Also, since the cutting workshop is separated from the product making workshop, the product making workshop can has various kinds of functions and in addition the cutting workshop can be made in small size and have operation characteristics.

Particularly, the present invention does not utilize harbor facilities on land at all there is no limitation to place, and the breaking-up can be carried out at any place if waves are calm there.

WHAT IS CLAIMED IS:

1. A method of breaking-up a ship hull characterized by utilizing a cutting workshop having its own buoyancy and a product making workshop connected to said cutting workshop and having its own buoyancy, drawing a hull to be broken up into said cutting workshop and breaking up said hull, transferring the obtained broken-up objects to said product making workshop where said objects are worked into given products, power etc. necessary for said cutting workshop being supplied from said product making workshop.

2. A method of breaking up a ship hull as claimed in claim 1, wherein the stem or stern of the hull is floated up above the water surface, the cutting workshop is located at the floated portion, and the breaking-up is carried out so as to gradually shorten the length of the hull.

3. A method of breaking up a ship hull as claimed in claim 1, wherein a portion of the hull is floated up by inclining the hull by inserting a buoyancy body under the stem or stern of the hull, the cutting workshop is located at the floated portion, the hull and the marine workshop are connected by means of a wire thereby giving a relative movement between the hull and the marine workshop, and at the same time the hull is broken up so as to gradually shorten the length of the hull.

4. A method of breaking up a ship hull as claimed in claim 1, comprising the steps of floating up one of the stem and stern of the hull by means of a buoyancy body, locating the cutting workshop having buoyancy under said floated portion, cutting the hull so as to shorten the length of the hull and drawing the hull into the cutting workshop by displacement means when moving the relative position between the hull and the marine workshop.

* * * * *